US008998388B2

(12) United States Patent
Cattaneo et al.

(10) Patent No.: US 8,998,388 B2
(45) Date of Patent: Apr. 7, 2015

(54) METHOD FOR MANUFACTURING A FLUID EJECTION DEVICE AND FLUID EJECTION DEVICE

(71) Applicant: STMicroelectronics S.r.l., Agrate Brianza (IT)

(72) Inventors: Mauro Cattaneo, Sedriano (IT); Roberto Campedelli, Novate Milanese (IT); Igor Varisco, Settimo Milanese (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 14/253,276

(22) Filed: Apr. 15, 2014

(65) Prior Publication Data

US 2014/0313264 A1 Oct. 23, 2014

(30) Foreign Application Priority Data

Apr. 18, 2013 (IT) ..... TO2013A0312

(51) Int. Cl.
*B41J 2/045* (2006.01)
*B41J 2/14* (2006.01)
*B41J 2/16* (2006.01)

(52) U.S. Cl.
CPC ..... *B41J 2/045* (2013.01); *B41J 2/14233* (2013.01); *B41J 2/161* (2013.01); *B41J 2/1623* (2013.01)

(58) Field of Classification Search
CPC ..... B41J 2/14233; B41J 2/045; B41J 2/1623; B41J 2/161
USPC ..... 347/68, 70–72; 29/25.35, 890.1
See application file for complete search history.

(56) References Cited

U.S. PATENT DOCUMENTS 7,305,764 B2 * 12/2007 Kitahara ..... 29/890.1
7,712,878 B2 * 5/2010 Takabe et al. ..... 347/68
2008/0239017 A1 10/2008 Takabe et al.

FOREIGN PATENT DOCUMENTS

EP 1 671 794 A1 6/2006

* cited by examiner

*Primary Examiner* — An Do
(74) *Attorney, Agent, or Firm* — Seed IP Law Group PLLC

(57) ABSTRACT

A method for manufacturing a fluid ejection device, comprising the steps of: providing a first semiconductor body having a membrane layer and a piezoelectric actuator which extends over the membrane layer; forming a cavity underneath the membrane layer to form a suspended membrane; providing a second semiconductor body; making, in the second semiconductor body, an inlet through hole configured to form a supply channel of the fluid ejection device; providing a third semiconductor body; forming a recess in the third semiconductor body; forming an outlet channel through the third semiconductor body to form an ejection nozzle of the fluid ejection device; coupling the first semiconductor body with the third semiconductor body and the first semiconductor body with the second semiconductor body in such a way that the piezoelectric actuator is completely housed in the first recess, and the second recess forms an internal chamber of the fluid ejection device.

19 Claims, 13 Drawing Sheets

METHOD FOR MANUFACTURING A FLUID EJECTION DEVICE AND FLUID EJECTION DEVICE

BACKGROUND

1. Technical Field

The present disclosure relates to a method for manufacturing a fluid ejection device and to a fluid ejection device. In particular, the present disclosure regards a process for manufacturing a head for fluid emission based upon piezoelectric technology, and to a head for fluid emission based on piezoelectric technology.

2. Description of the Related Art

Multiple types of fluid ejection devices are known in the prior art, in particular inkjet heads for printing applications (known as printheads). Heads of this sort, with appropriate modifications, may moreover be used for emission of fluids other than ink, for example, for applications in the biological or biomedical fields, for local application of biological material (e.g., DNA) during manufacture of sensors for biological analyses.

Known manufacturing methods envisage coupling via gluing or bonding of a large number of pre-machined wafers; said method is costly and typically requires high precision, and the resulting device has a large thickness.

BRIEF SUMMARY

One or more embodiments of the present disclosure provide a method for manufacturing a fluid ejection device and a corresponding fluid ejection device.

For example, one embodiment is directed to a method for manufacturing a fluid ejection device. The method includes forming a first recess in a first semiconductor by removing selective portions of the first semiconductor body. The first semiconductor body includes a membrane layer and a piezoelectric actuator located over the membrane. The selective portions are removed until the membrane layer is reached. The method further includes forming an intermediate through hole through the membrane by removing a selective portion of the membrane layer and providing a second semiconductor body having a first surface and a second surface. The method further includes forming a second recess in a third semiconductor body. The method further includes forming an outlet through hole in the third semiconductor body by removing selective portions of the third semiconductor body outside of said second recess. The outlet through hole forms a fluid ejection nozzle of the fluid ejection device. The first and third semiconductor bodies coupled together. This coupling includes housing the piezoelectric actuator in the first recess and the intermediate through hole, the first recess, and the outlet through hole are fluidically coupled to each other. The method also includes coupling together the first semiconductor body and the second semiconductor body. This coupling includes forming a chamber inside the fluid ejection device with a first surface of the second semiconductor body facing the first recess.

BRIEF DESCRIPTION OF THE SEVERAL VIEWS OF THE DRAWINGS

For a better understanding of the present disclosure, preferred embodiments thereof are now described purely by way of non-limiting example with reference to the attached drawings, wherein.

DETAILED DESCRIPTION

Figure 1:
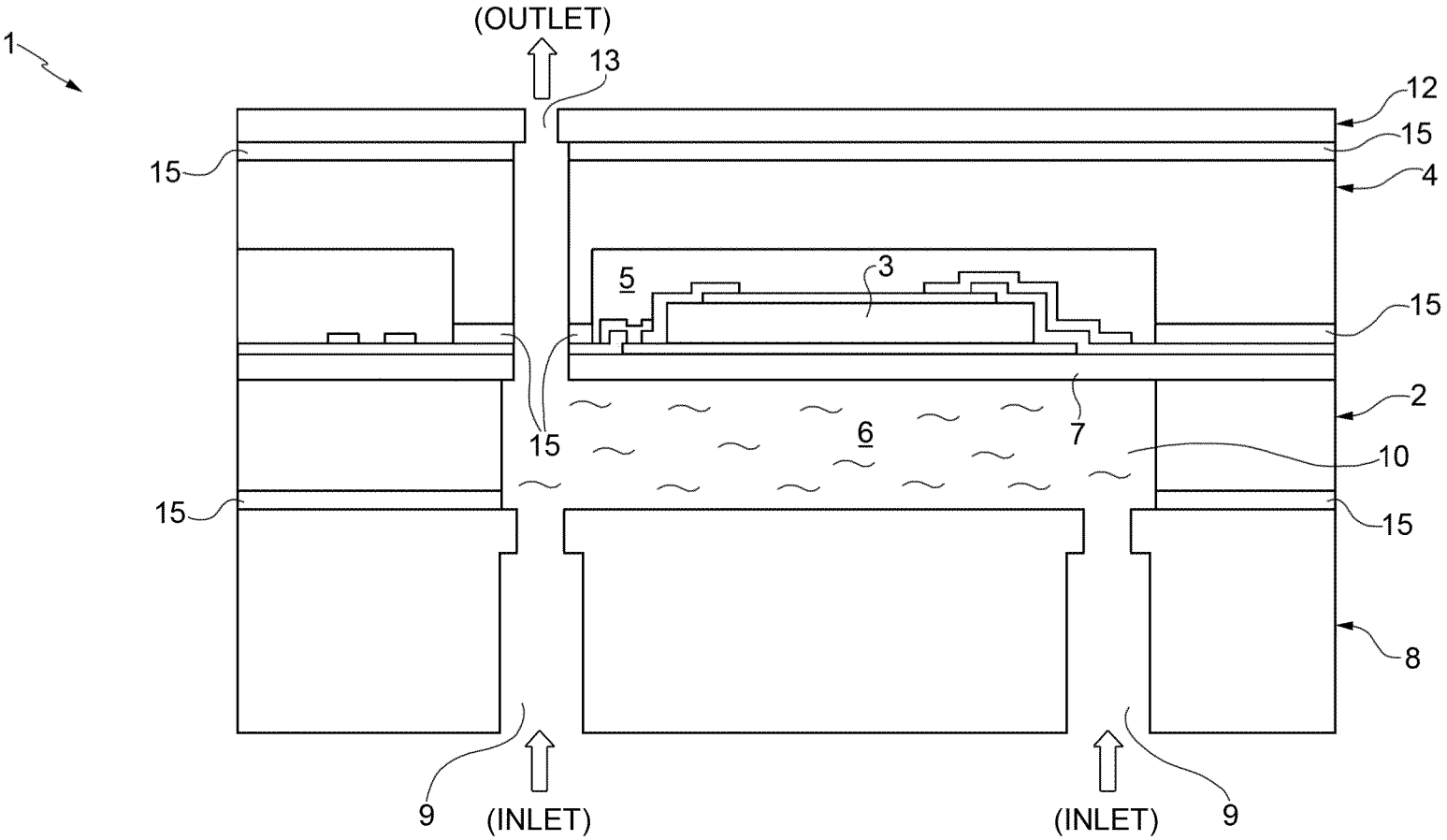
FIG. 1 shows a fluid ejection device according to one embodiment that does not form part of the present disclosure.

Fluid ejection devices based upon piezoelectric technology can be produced by bonding or gluing together a plurality of wafers machined previously using micromachining technologies typically used for manufacturing MEMS (microelectromechanical systems) devices. In particular, FIG. 1 shows a liquid-ejection device 1 that does not form part of the present disclosure. With reference to FIG. 1, a first wafer 2 is machined so as to form thereon one or more piezoelectric actuators 3, designed to be controlled for generating a deflection of a membrane 7, which extends partially suspended over one or more chambers 10 that are designed to define respective reservoirs for containing fluid 6 to be expelled during use. A second wafer 4 is machined so as to form one or more chambers 5 for containing the piezoelectric actuators 3 such as to insulate, in use, the piezoelectric actuators 3 from the fluid 6 to be expelled; a third wafer 8 is machined to form one or more inlet holes 9 of the fluid 6, in fluid connection with the chambers 10; and a fourth wafer 12 is machined to form holes 13 for expelling the fluid 6 (outlet holes). Then, the aforementioned wafers 2, 4, 8 and 12 are assembled together by means of bonding regions and/or gluing regions and/or adhesive regions. Said regions are designated as a whole in FIG. 1 by the reference number 15.

Following upon steps of bonding/gluing, the fluid ejection device 1 of FIG. 1 is obtained.

The manufacturing process described with reference to FIG. 1 involves machining of at least four wafers made of semiconductor material in separate steps, and steps of assembly of said wafers to obtain the finished fluid ejection device. This leads to high manufacturing costs and a greater complexity of machining and integration on account of the large number of wafers that are to be machined. Furthermore, the steps of assembly of the wafers typically require a high precision, and any possible misalignment between the wafers during assembly may entail both structural weaknesses and a non-optimal operation of the finished device.

With reference to FIGS. 2-23, there now follows a description of a process for manufacturing a fluid ejection device 50 (illustrated in FIG. 24 at the end of the manufacturing steps), according to one embodiment of the present disclosure that overcomes one or more of the drawbacks described with reference to the steps for manufacture of the device of FIG. 1.

In particular, FIGS. 2-5 describe steps for micromachining a top wafer including one or more cavities for housing piezoelectric actuators and one or more fluid ejection holes or nozzles (or outlet nozzles). FIGS. 6-13 describe steps for micromachining an intermediate wafer that houses the piezoelectric actuators. Finally, FIG. 16 describes steps for micromachining a bottom wafer that houses fluid-access channels or inlet channels.

FIGS. 14A-15 and 17-23 describe steps for coupling together the aforementioned wafers, and further manufacturing steps for completing formation of the fluid ejection device according to the present disclosure.

Hence, according to the present disclosure, the steps of manufacture of the fluid ejection device 50 envisage machining and assembly of a small number of wafers (in particular, three wafers).

Figure 2:
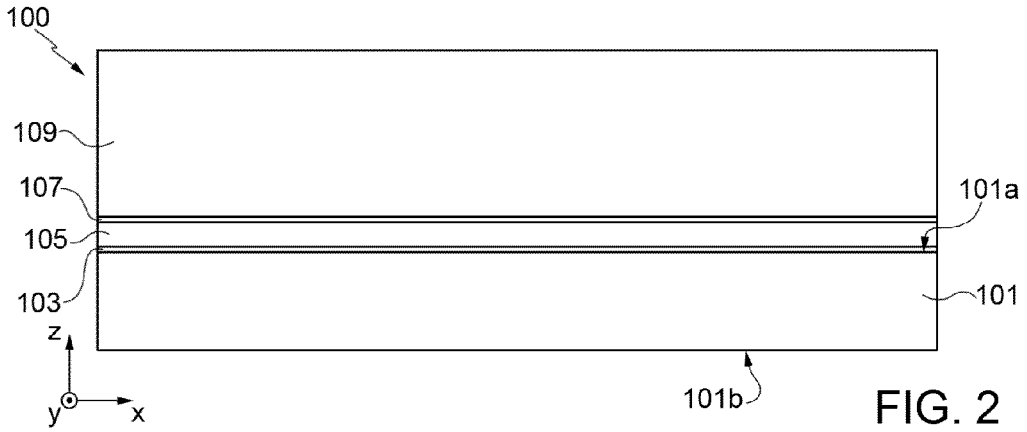
FIGS. 2-23 show steps of manufacture of a fluid ejection device according to one embodiment of the present disclosure.

With reference to FIG. 2, a wafer 100, including a substrate 101, is provided, for example having a thickness of between approximately 400 and 1000 μm, in particular approximately 725 μm. The substrate 101 is, according to one embodiment of the present disclosure, made of semiconductor material, such as silicon. The substrate 101 has a first surface 101*a* and a second surface 101*b*, opposite to one another in a direction Z. On the first surface 101*a*, a first interface layer 103, made of silicon oxide (in particular, $SiO_2$) is formed by thermal oxidation. The first interface layer 103 has, for example, a thickness of between approximately 0.7 and 2 μm, in particular approximately 1 μm.

On top of the first interface layer 103 an intermediate layer 105 of epitaxially grown polysilicon is formed, having a thickness, for example, of between approximately 15 and 50 μm, in particular approximately 25 μm. In particular, the intermediate layer 105 is grown epitaxially until it reaches a thickness greater than the desired thickness (for example, approximately 3 μm more), and then is subjected to a step of CMP (chemical mechanical polishing) for reducing the thickness thereof and obtaining an exposed top surface with low roughness.

The intermediate layer 105 may be made of a material other than polysilicon, for example silicon or some other material, provided that it can be removed selectively with respect to the material of which the first interface layer 103 is made.

Formed on top of the intermediate layer 105 is a second interface layer 107, similar to the first interface layer 103 (e.g., made of silicon oxide $SiO_2$, with a thickness, for example, of between 0.7 and 2 μm, in particular approximately 1 μm).

Formed on top of the second interface layer 107 is a structural layer 109, for example of polysilicon. The structural layer 109 has a thickness, for example, of between approximately 80 and 150 μm, in particular 105 μm. The structural layer 109 is, for example, grown epitaxially on top of the second intermediate layer 107 until it reaches a thickness greater than the desired thickness (for example, approximately 3 μm more), and is then subjected to a step of CMP for reducing the thickness thereof and obtaining an exposed top surface with low roughness.

Figure 3A:
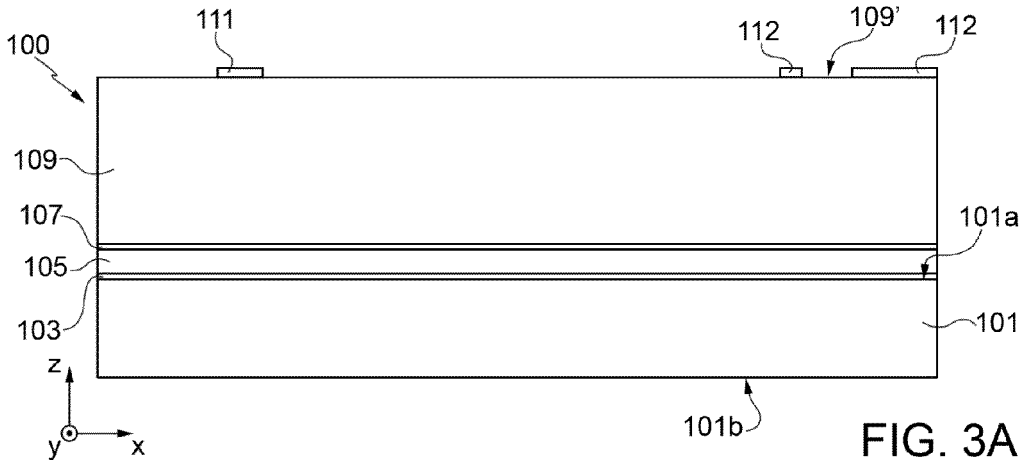

With reference to FIG. 3A, the substrate 101 could be reduced in thickness by means of the grinding technique until it reaches a thickness, for example, of between 400 and 600 μm, for example 600 μm. This is followed by a step of forming a mask on top of the wafer 100, above the structural layer 109. For this purpose, a mask layer is formed, e.g., of TEOS (tetraethyl orthosilicate) oxide deposited with the PECVD technique, having a thickness of approximately 2.5 μm, on top of the structural layer 109. The mask layer is defined lithographically so as to form an edge-mask region 111 and a nozzle-mask region 112. The edge-mask region 111 is designed to delimit a portion of the wafer 100 that, in subsequent steps, will contain a layer of glue or adhesive layer from a portion of the wafer 100 that, in subsequent steps, will operate as chamber for containing a piezoelectric actuator. The nozzle-mask region 112 is designed to delimit a surface portion 109' of the wafer 100 in which part of the liquid-ejection channel is to be formed. In particular, the surface portion 109' has, in top view, a substantially rectangular shape, with chamfered corners.

Figure 3B:
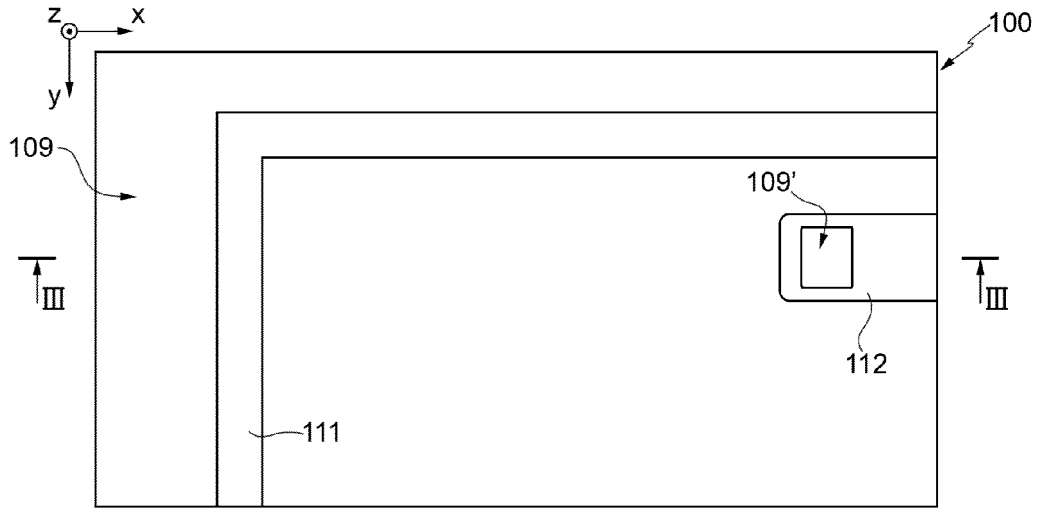

FIG. 3B is a schematic top view of the wafer 100, where the edge-mask region 111 and the nozzle-mask region 112 are visible. The cross-sectional view of FIG. 3A is taken along the line of section III-III of FIG. 3B.

Figure 4:
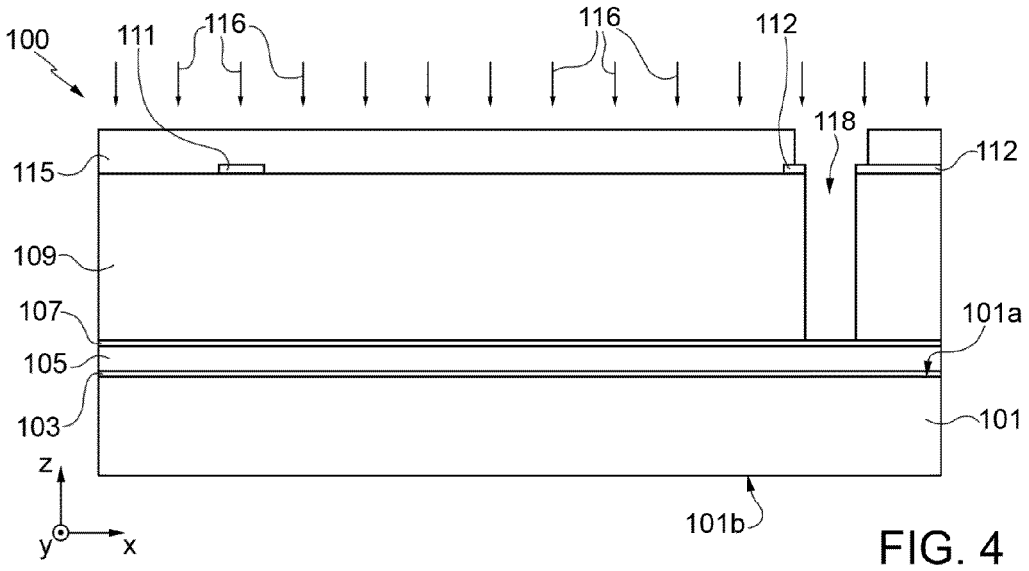

With reference to FIG. 4, a photoresist mask 115 is formed on the wafer 100 designed to coat the surface of the wafer 100 except for the surface portion 109'. By means of a dry-etching step (indicated by the arrows 116), the region of the structural layer 109 that extends into an area corresponding to the surface portion 109' not protected by the mask 115 is partially or completely removed. According to the embodiment illustrated in FIG. 4, the structural layer 109 is removed completely until the second intermediate layer 107, which operates as etch-stop layer, is reached.

There is thus formed a channel 118 that extends throughout the thickness of the structural layer 109.

Alternatively (in a way not shown in the figure), it is possible to partially remove the structural layer 109, up to a depth of, for example, 80 μm, and complete the etching step subsequently, during the step of FIG. 5.

Figure 5:
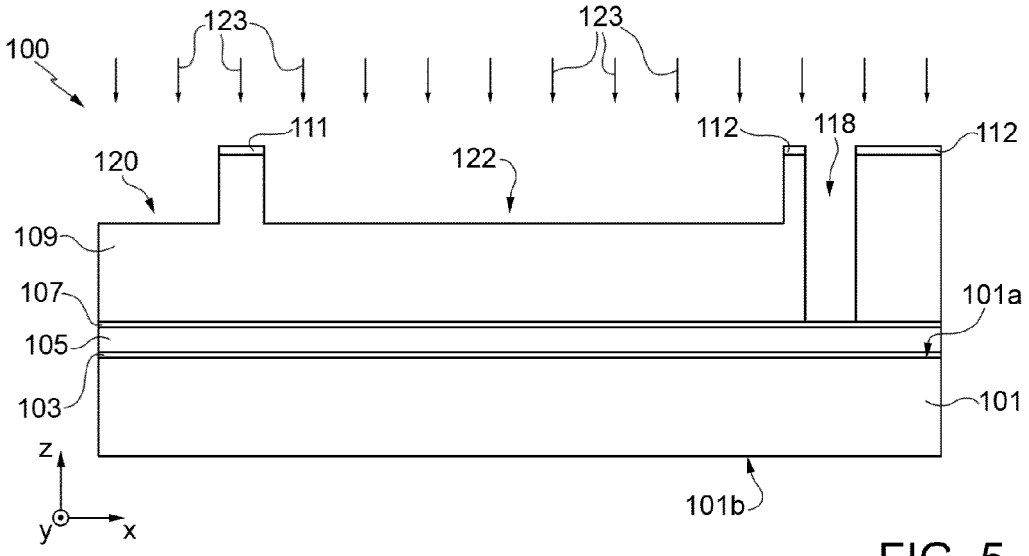

As shown in FIG. 5, the mask 115 is removed, and then a further etching step is performed, identified in the figure by the arrows 123, in order to remove portions of the structural layer 109 not protected by the edge-mask regions 111 and nozzle-mask regions 112. In one embodiment, the etch is of a dry type, and the etching chemistry is chosen in such a way as to remove selectively the material of which the structural layer 109 is made but not the material of which the second intermediate layer 107 is made.

Thus formed in the structural layer 109 is a pad recess 120 and a piezoelectric-housing recess 122, which are separated from one another by the edge-mask regions 111 and by the structural-layer portion 109 lying underneath the latter. The depth, in the structural layer 109, of the pad recess 120 and of the piezoelectric-housing recess 122 is comprised, for example between 20 and 50 μm, for example 25 μm. During this etching step, it is possible to complete etching of the channel 118 in the case where the step of FIG. 4 has not enabled the second intermediate layer 107 to be reached. Instead, since the etching chemistry for removal of the structural layer 109 is chosen in such a way as to remove selectively the structural layer 109 but not the intermediate layer 107, etching of the channel 118 does not proceed any further in depth in the wafer 100.

With reference to FIGS. 6-13, there are now described steps of machining of a wafer 200 that houses one or more actuator elements (e.g., piezoelectric elements), designed to be operated, in use, for expelling fluid from the fluid ejection device according to the present disclosure.

Figure 6:
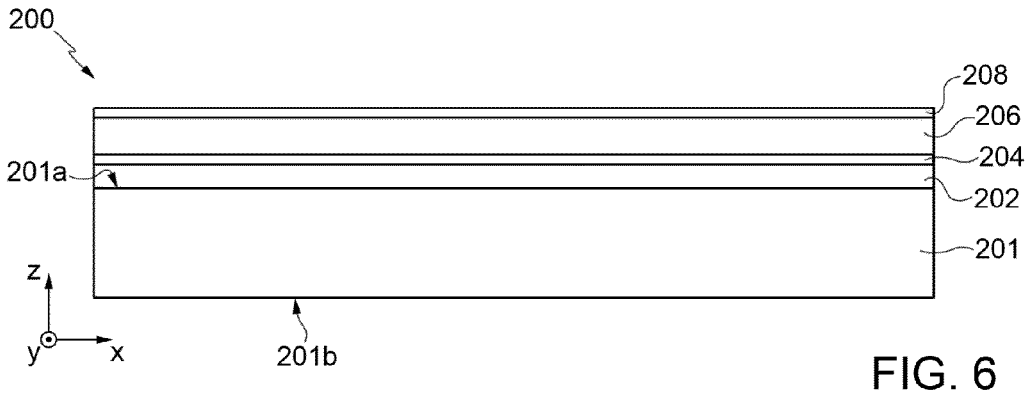

With reference to FIG. 6, the wafer 200 is provided, including a substrate 201, for example having a thickness of between approximately 400 and 1000 μm, in particular approximately 725 μm. The substrate 201 is, according to one embodiment of the present disclosure, made of semiconductor material, such as silicon. The substrate 201 has a first surface 201*a* and a second surface 201*b*, opposite to one another in the direction Z. On the first surface 201*a*, a membrane layer 202 is formed, for example of silicon oxide, having a thickness, for example, of between approximately 1 and 4 μm, in particular 2.5 μm. This is followed by formation of a stack including a piezoelectric element and electrodes for actuation of the piezoelectric element. For this purpose, deposited on the wafer 200, above the membrane layer 202, is a first layer of conductive material 204, for example titanium (Ti) or platinum (Pt), having a thickness, for example, of between approximately 20 and 100 nm; then, on top of the first layer of conductive material 204, a layer of piezoelectric material 206, for example PZT (Pb, Zr, $TiO_3$), having a thickness, for example, of between 1.5 and 2.5 μm, in particular 2

μm, is deposited; then, deposited on top of the layer of piezoelectric material 206 is a second layer of conductive material 208, for example ruthenium, having a thickness, for example of between approximately 20 and 100 nm.

Figure 7:
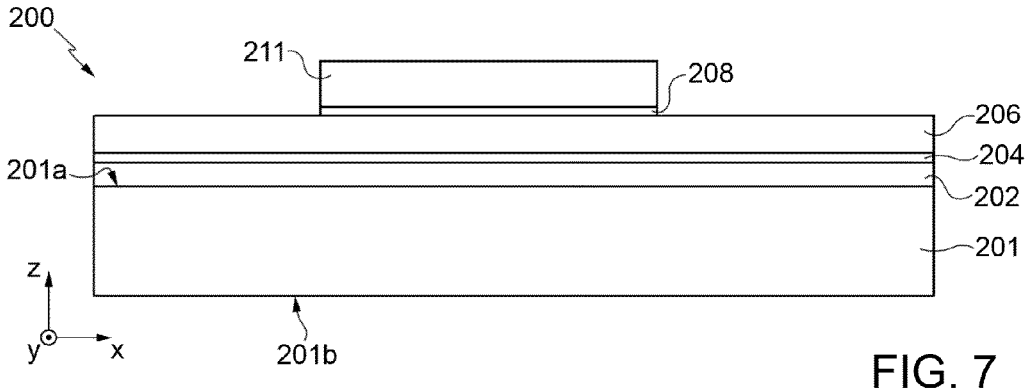
Figure 8:
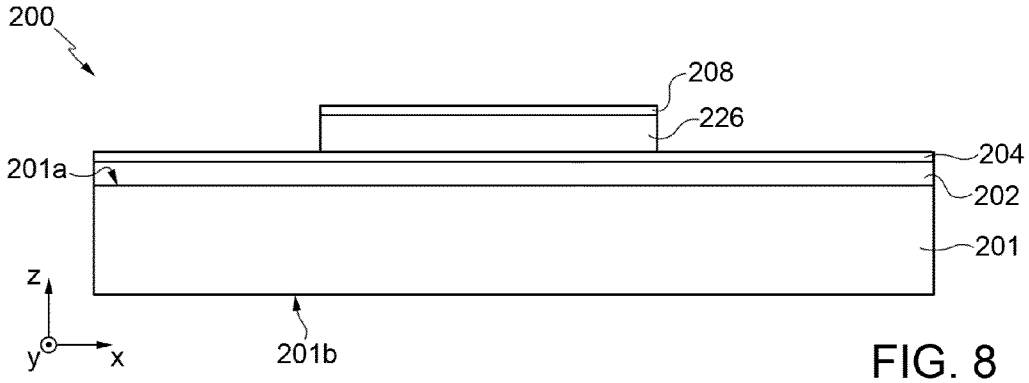

As shown in FIG. 7, formed on top of the second layer of conductive material 208 is a mask 211, designed to cover the second layer of conductive material 208 in an area corresponding to portions of the latter that will form, subsequently, a top electrode for actuation of the piezoresistive element. An etching step enables removal of portions of the second layer of conductive material 208 not protected by the mask 211. Using the same mask 211, but different etching chemistry, etching of the wafer 200 is continued to remove exposed portions of the layer of piezoelectric material 206 so as to form a piezoelectric element 226. Etching is interrupted at the first layer of conductive material 204, and (FIG. 8) the mask 211 is removed. Etching of the second layer of conductive material 208 is carried out, for example, by means of wet etching, and etching of the piezoelectric layer 206 by means of dry or wet etching.

Figure 9:
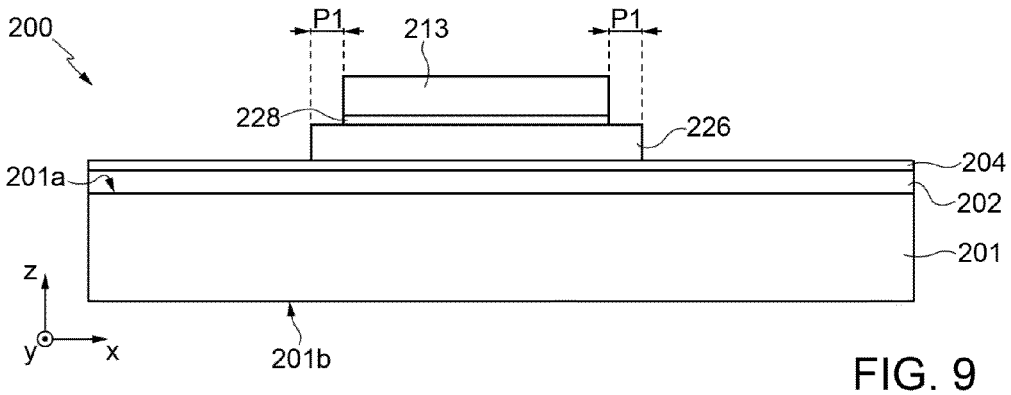

As shown in FIG. 9, the second layer of conductive material 208 is defined so as to conclude formation of the top electrode. For this purpose, a mask 213 (for example, a photoresist mask) is formed on top of part of the second layer of conductive material 208 in such a way as to remove selective portions thereof that extend at the outer edge of the piezoelectric element 226, but not portions of the second layer of conductive material 208 that extend at the centre of the piezoelectric element 226.

The portion of the piezoelectric element 226 exposed following upon the etching step of FIG. 9 forms, in top view, a frame that surrounds the top electrode 228 completely or partially and has a width P1, for example, measured in the direction X, of between 4 and 8 μm. There is thus formed a top electrode 228, designed to be biased, in use, for activating the piezoelectric element 226 (as illustrated more clearly in what follows).

Figure 10:
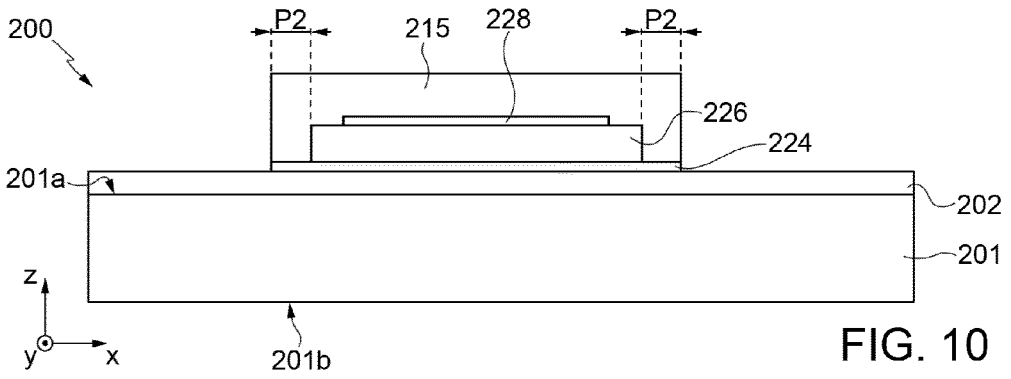

As shown in FIG. 10, a mask 215 (for example, a photoresist mask) is formed, which is designed to protect the top electrode 228 and the piezoelectric element 226 and extends laterally with respect to the piezoelectric element 228 for a distance P2, measured in the direction X starting from the edge of the piezoelectric element 228, of, for example, between 2 and 8 μm. This is followed by an etching step to remove portions of the first layer of conductive material 204 not protected by the mask 215. A bottom electrode 224 is thus formed for actuating the piezoelectric element in use.

Figure 11:
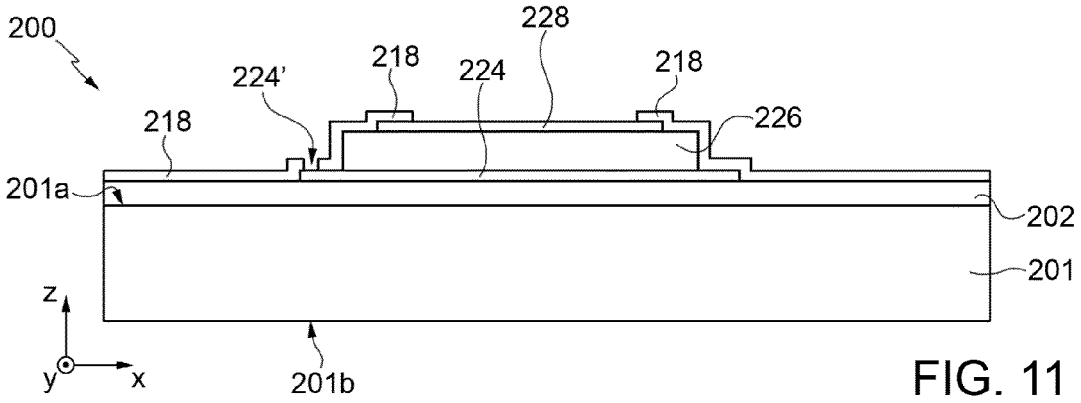

As shown in FIG. 11, the mask 215 is removed from the wafer 200, and a step of deposition of a passivation layer 218 is carried out on the wafer 200. The passivation layer is, for example, silicon oxide $SiO_2$ deposited with the PECVD technique, and has a thickness, for example, of between approximately 15 and 495 nm, for example approximately 300 nm.

By means of a subsequent lithography and etching step, the passivation layer 218 is selectively removed in a central portion of the top electrode 228, whereas it remains in at an edge portion of the top electrode 228, of the piezoelectric element 226, of the bottom electrode 224, and of exposed portions of the membrane layer 202.

According to what has been described so far, the passivation layer 218 does not cover the top electrode 228 completely, which can hence be contacted electrically by means of a conductive path. Instead, the bottom electrode 224 may not be accessible electrically, being completely protected by the overlying piezoelectric element 226 and by the passivation layer 218. Then, simultaneously, a step is performed of selective removal of a portion of the passivation layer 218 in an area corresponding to the bottom electrode 224, and in particular in an area corresponding to the portion of the bottom electrode 224 that extends, in the plane XY, beyond the outer edge of the piezoelectric element 226. In this way, a region 224' of the bottom electrode 224 is exposed and can thus be contacted electrically by means of a conductive path of its own. The openings to form the electrical contacts with the top electrode 228 and the bottom electrode 224 can be made during one and the same lithography and etching step (in particular, using one and the same mask).

Figure 12:
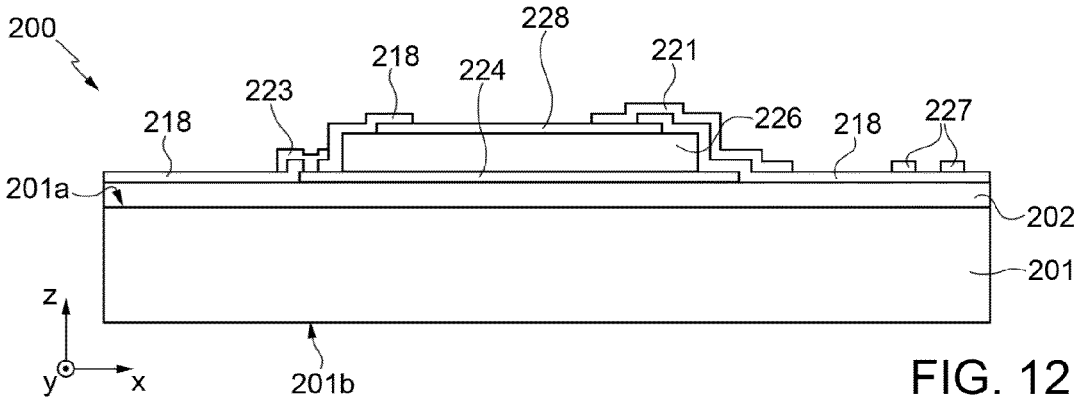

The step of forming a first conductive path 221 and a second conductive path 223 is illustrated in FIG. 12. For this purpose, a step of deposition of conductive material, such as for example a metal, in particular titanium or gold, is carried out until a layer is formed having a thickness, for example, of between approximately 20 and 500 nm, for example approximately 400 nm. By means of photolithography steps, the layer of conductive material thus deposited is selectively etched to form the first conductive path 221, which extends over the wafer 200 in electrical contact with the top electrode 228, and the second conductive path 223, which extends over the wafer 200 in electrical contact with the bottom electrode 224 through the region 224' formed previously. The first and second conductive paths 221, 223 extend over the wafer 200 until regions where it is desired to form conductive pads 227 are reached, which are designed to operate as electrical access points for biasing, in use, the top electrode 228 and the bottom electrode 224 so as to activate the piezoelectric element 226 in a way in itself known.

Figure 13:
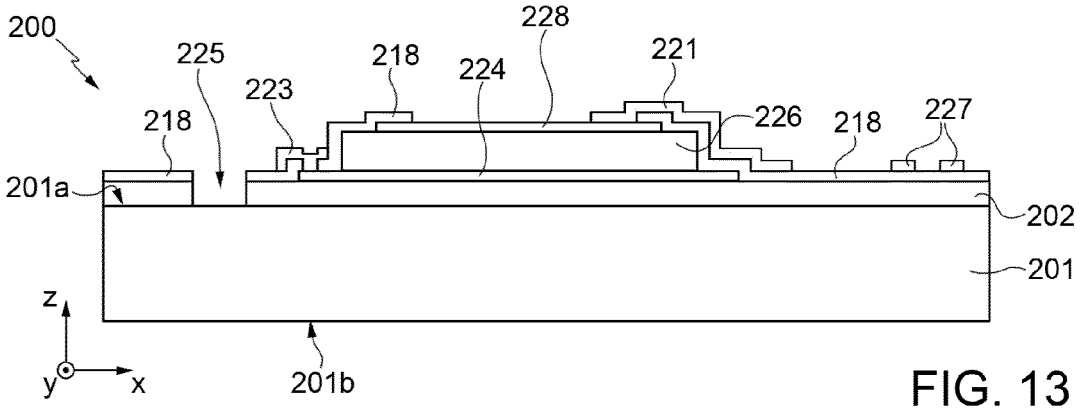

As shown in FIG. 13, the passivation layer 218 and the membrane layer 202 are selectively etched in a region which extends alongside the stack formed by the bottom electrode 224, the piezoelectric element 226, and the top electrode 228, to form a trench 225 that exposes a surface portion of the substrate 201. The trench 225 has a quadrangular or circular shape, in any case with a maximum diameter such as to be completely contained, in top view when aligned along Z, by the channel 118 illustrated in FIG. 4. In particular, according to one embodiment, the trench 225 has, in top view, a shape that is the same as the shape chosen, once again in top view, for the channel 118. In any case, irrespective of the shape chosen for the trench 225, in subsequent manufacturing steps the trench 225 will be set aligned, in the direction Z, with the channel 118 so that the channel 118 and the trench 225 will be in fluid connection with one another (this step is illustrated in greater detail in FIGS. 14A and 14B). Furthermore, the piezoelectric-housing recess 122, formed in the wafer 100, is designed to house the piezoelectric element 226 and the top electrode 228 and the bottom electrode 224. The piezoelectric-housing recess 122 surrounds the piezoelectric element 226 completely and insulates it fluidically from the external environment and above all from the channel 118, which extends outside the piezoelectric-housing recess 122. In this way, when in use the fluid ejection device interacts with the fluid to be ejected, the piezoelectric element is not in contact with said fluid.

The process steps described with reference to FIGS. 2-5 (machining of the wafer 100) and 6-13 (machining of the wafer 200) can be carried out indifferently either in parallel or sequentially.

Figure 14A:
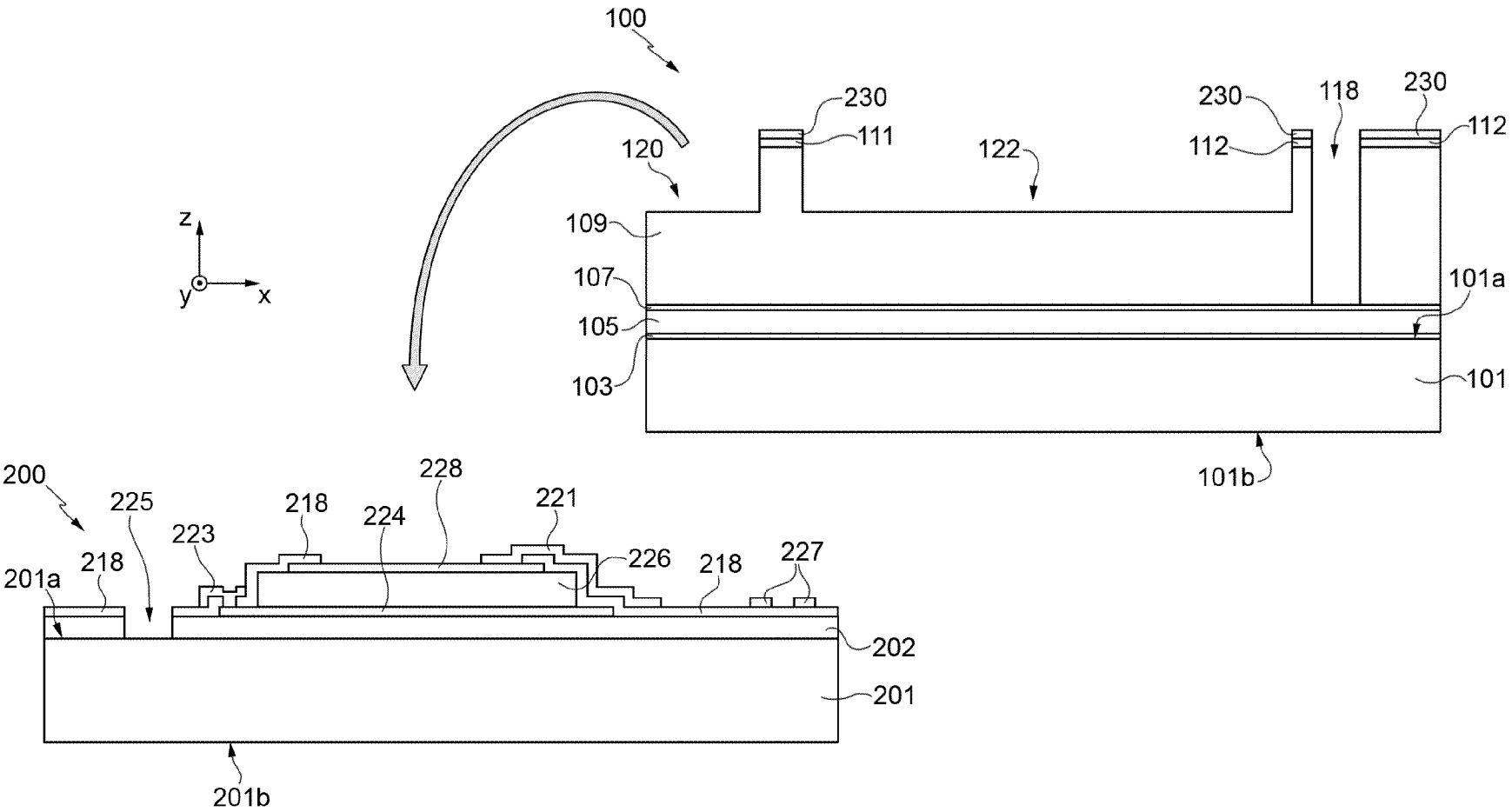
Figure 14B:
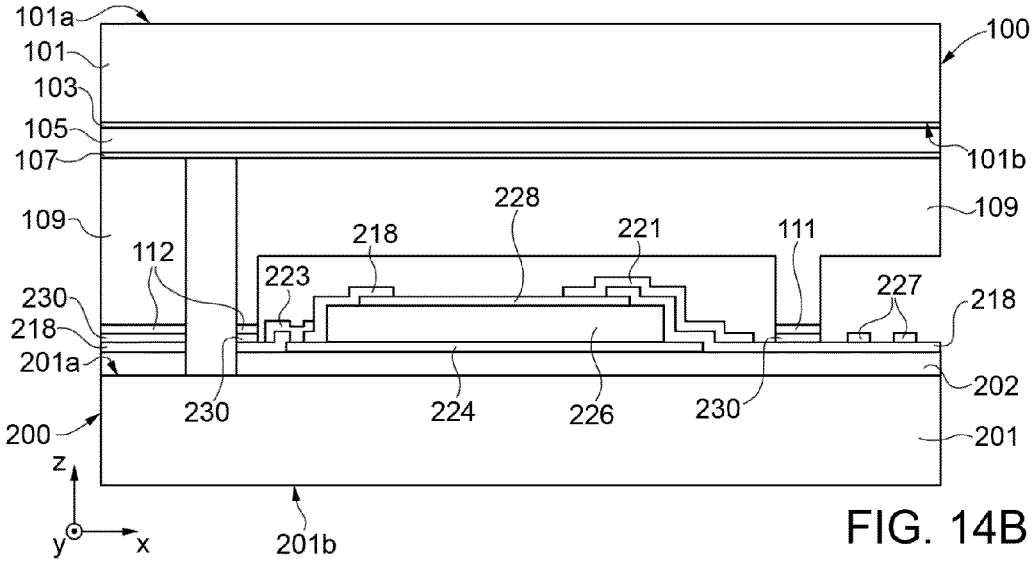

In any case, with reference to FIG. 14A, the wafer 100 (in the machining step of FIG. 5) and the wafer 200 (in the machining step of FIG. 13) are coupled together in such a way that the channel 118 and the trench 225 will be substantially aligned with one another in the direction Z, and in fluid connection with one another. FIG. 14B shows the wafer 100 and the wafer 200 at the end of the coupling step of FIG. 14A.

With reference to the wafer 100, the portions of the structural layer 109 that extend to a height, along Z, greater than the recesses 120 and 122 are the portions of the structural layer 109 protected by the edge-mask region 111 and by the nozzle-mask region 112. During the coupling step of FIGS. 14A and 14B, it is the edge-mask regions 111 and nozzle-mask regions 112 that provide part of the coupling interface between the wafers 100 and 200. To guarantee a good adhesion between the wafers 100 and 200, a bonding polymer 230 is applied on the wafer 100 in the edge-mask regions 111 and nozzle-mask regions 112; after the step of alignment and coupling between the wafers 100 and 200, a step of thermal treatment (which may vary in time and in temperature according to the bonding polymer 230 used) enables completion of adhesion between the wafers 100 and 200.

Figure 15:
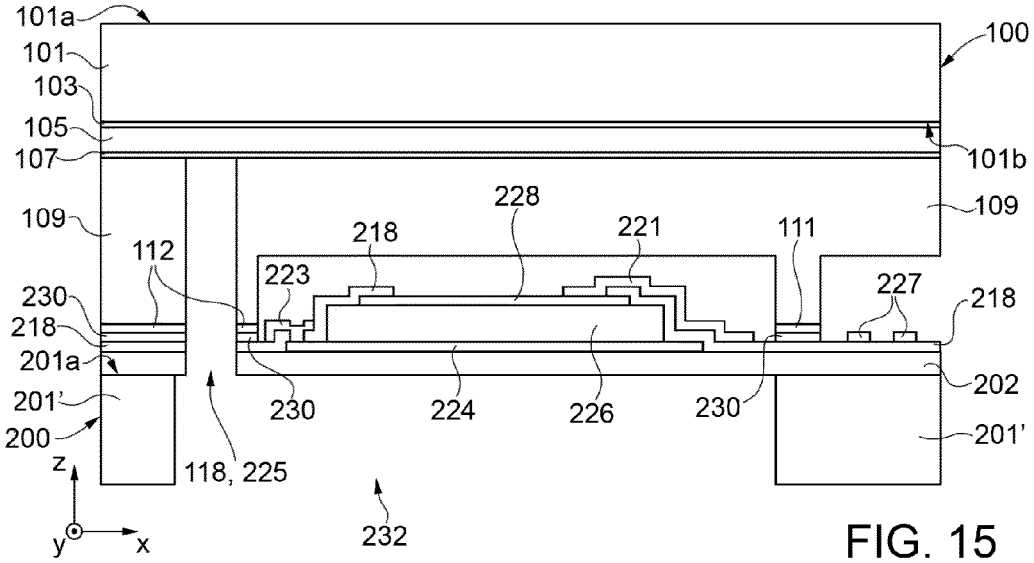

With reference to FIG. 15, the substrate 201 of the wafer 200 is subjected to a grinding step to reduce the thickness thereof to a value of approximately 70 μm. By means of successive lithography and etching steps, the remaining portion of the substrate 201 is selectively etched until the membrane layer 202 is reached so as to open a chamber 232 in an area corresponding to the piezoelectric element 226 (in other words, the chamber 232 is aligned, in the direction Z, to the piezoelectric element 226). The chamber 232 moreover extends also towards the channel 118 and the trench 225 formed previously, which are thus fluidically accessible from outside. Portions 201' of the substrate 201 that extend, in top view, laterally with respect to the piezoelectric element 226, to the channel 118, and to the trench 225 are preserved.

Figure 16:
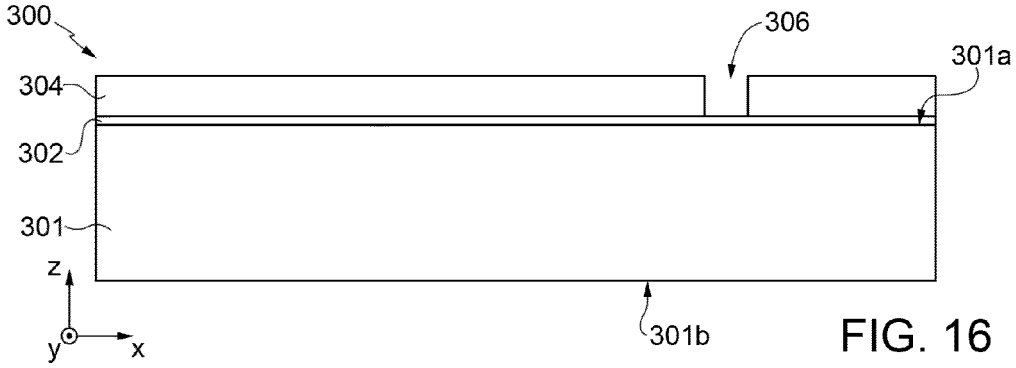

With reference to FIG. 16, the steps of machining of a wafer 300 are now described. The steps of FIG. 16 can be carried out simultaneously with any of the steps described with reference to FIGS. 2-15, either prior thereto or afterwards, indifferently.

With reference to FIG. 16, the wafer 300 including a substrate 301, made, for example, of semiconductor material, in particular silicon, is provided having a top face 301*a* and a bottom face 301*b*, opposite to one another in the direction Z. On the top face 301*a* an intermediate layer 302 is formed, made, for example, of silicon oxide $SiO_2$. Then, on top of the intermediate layer 302, a structural layer 304 is formed, made, for example, of semiconductor material, in particular silicon or polycrystalline silicon. The structural layer 304 has a thickness, for example, of between approximately 30 and 70 μm, for example approximately 50 μm. The structural layer 304 is selectively etched (by means of lithography and etching steps, in themselves known), to form a trench 306 that extends throughout the thickness of the structural layer 304 until the intermediate layer 302 is reached. The intermediate layer 302 functions, in this case, as etch-stop layer. The trench 306 has, in top view, a circular shape with a diameter of approximately 20 μm. However, other shapes and dimensions may be chosen, as desired. In subsequent manufacturing steps, the trench 306 forms an inlet channel for the fluid to be ejected.

Figure 17:
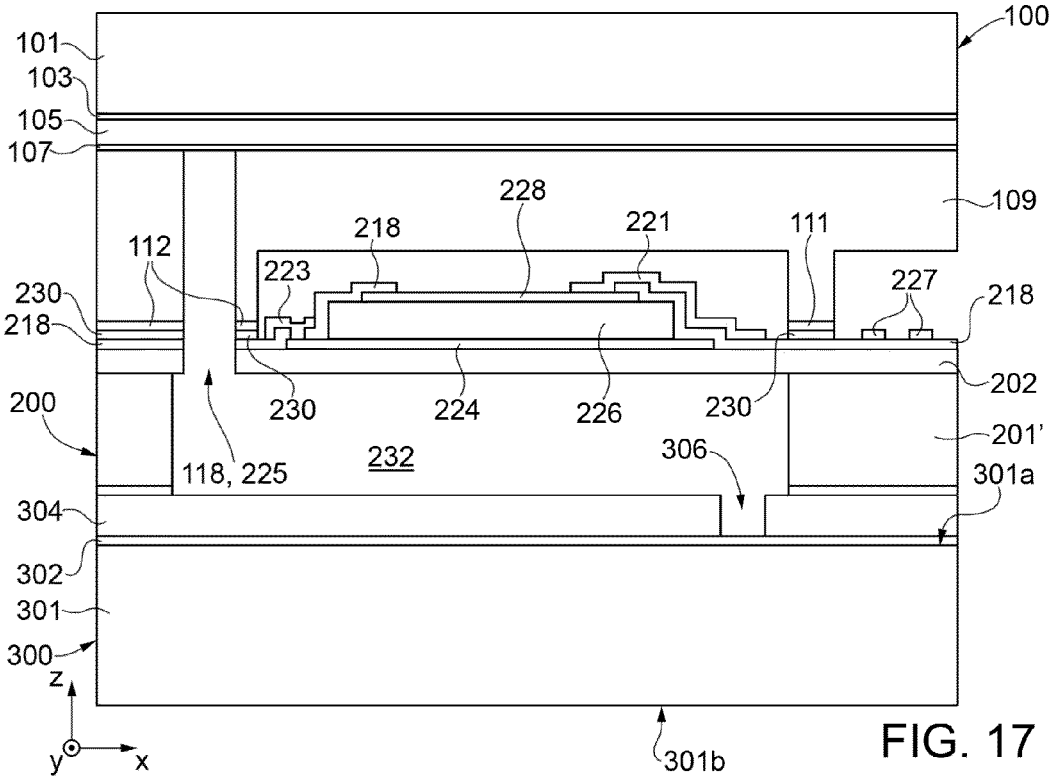

With reference to FIG. 17, the wafer 300 is coupled to the wafer 200 in such a way that the trench 306 is in fluid connection with the chamber 232. The coupling step is carried out, as described with reference to FIGS. 14A and 14B, using a bonding polymer 236, laid on the surface of the portions 201' of the substrate 201 of the wafer 200. Following upon alignment and physical coupling between the wafers 200 and 300, a step of thermal treatment of the bonding polymer 236 (in a way in itself known, according to the bonding polymer used) enables bonding of the wafers 200 and 300 together by means of the bonding polymer 236.

Figure 18:
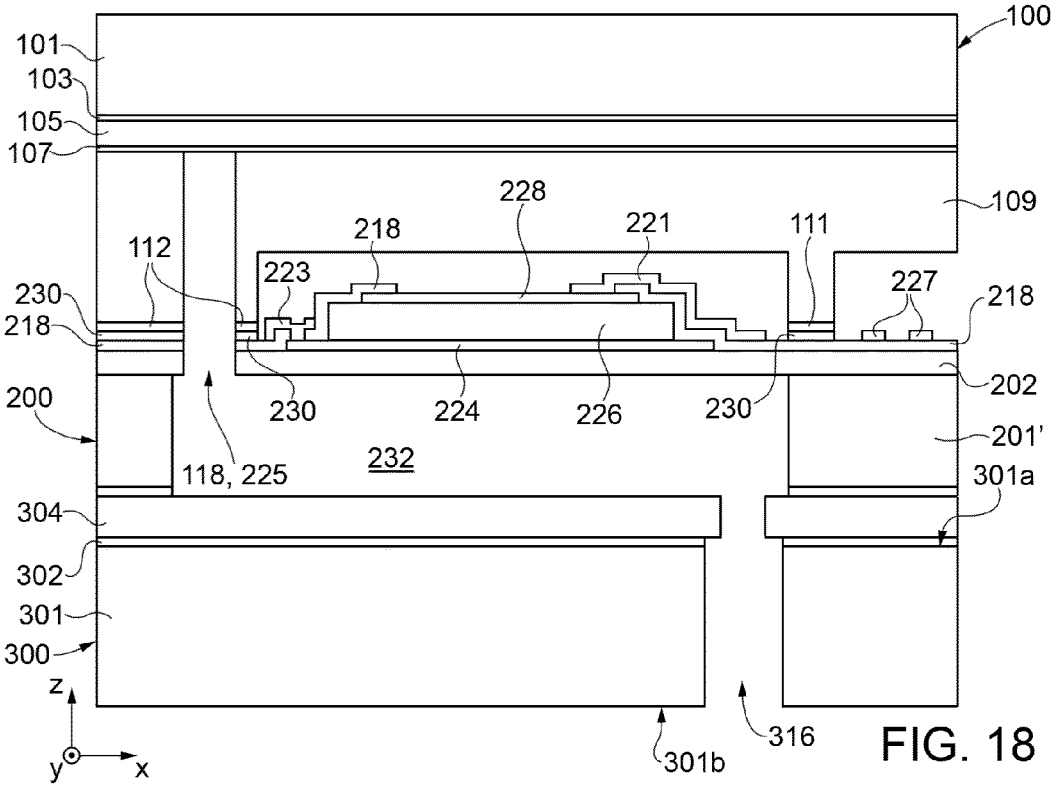
Figure 19:
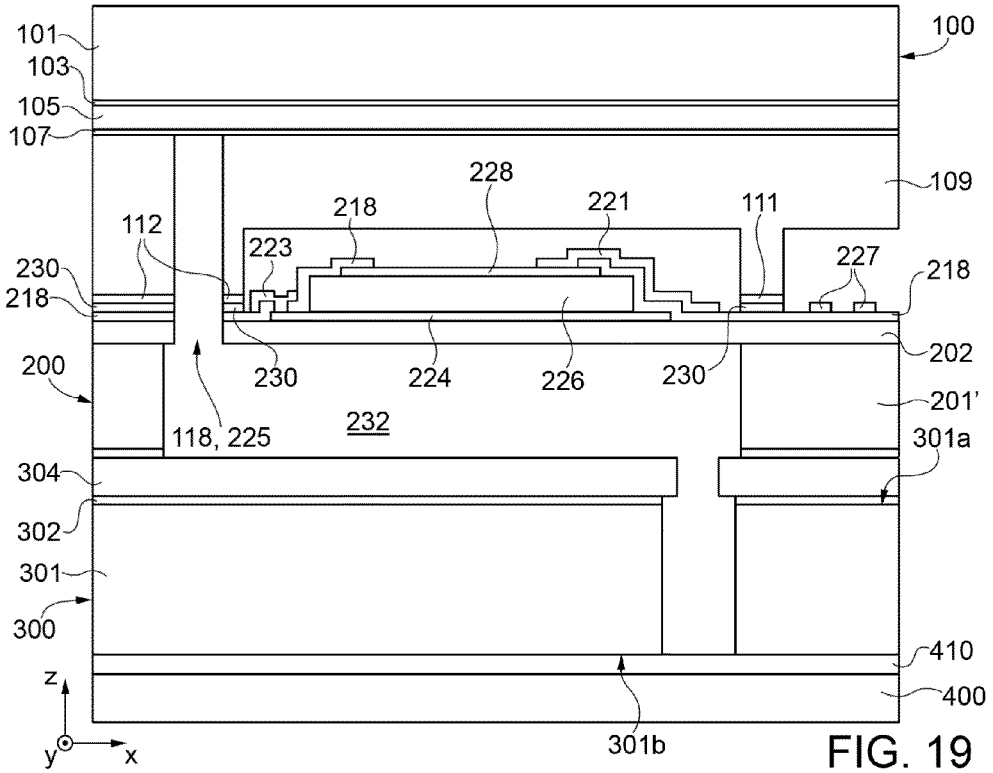

With reference to FIG. 18, a grinding step is carried out on the underside 301*b* of the substrate 301 of the wafer 300 to reduce the thickness of the substrate 301. The grinding step proceeds until a desired thickness of the substrate 301 is obtained, such approximately 150 μm. A subsequent step of chemical polishing of the exposed surface of the substrate 301 enables removal of possible imperfections deriving from the previous grinding step.

A masked-etching step is carried out so as to open a channel 312 throughout the thickness of the substrate 301 in an area corresponding to the trench 306, exposing a surface portion of the intermediate layer 302. The channel 312 is, in particular, aligned along Z with the trench 306. A further selective-etching step enables removal of the portion of the intermediate layer 302 exposed through the channel 312, setting the channel 312 in fluid communication with the trench 306 and thus forming a channel 316 for access to the chamber 232.

Subsequent manufacturing steps envisage the formation of the fluid ejection nozzle. Said nozzle is formed by machining the wafer 100 so as to set the chamber 232 in fluid communication with the outside world through the channel 118.

For this purpose (FIG. 19), to facilitate subsequent manufacturing steps, the wafer 300 is coupled, by means of a thermal-release biadhesive tape 410, with a fourth wafer 400 having the sole function of favoring handling of the device that is being produced. In subsequent steps, the fourth wafer 400 will be removed. The fourth wafer 400 is, for example, made of silicon and has a thickness of approximately 500 μm. The thermal-release biadhesive tape 410 is, for example, laid on the wafer 400 by lamination.

Figure 20:
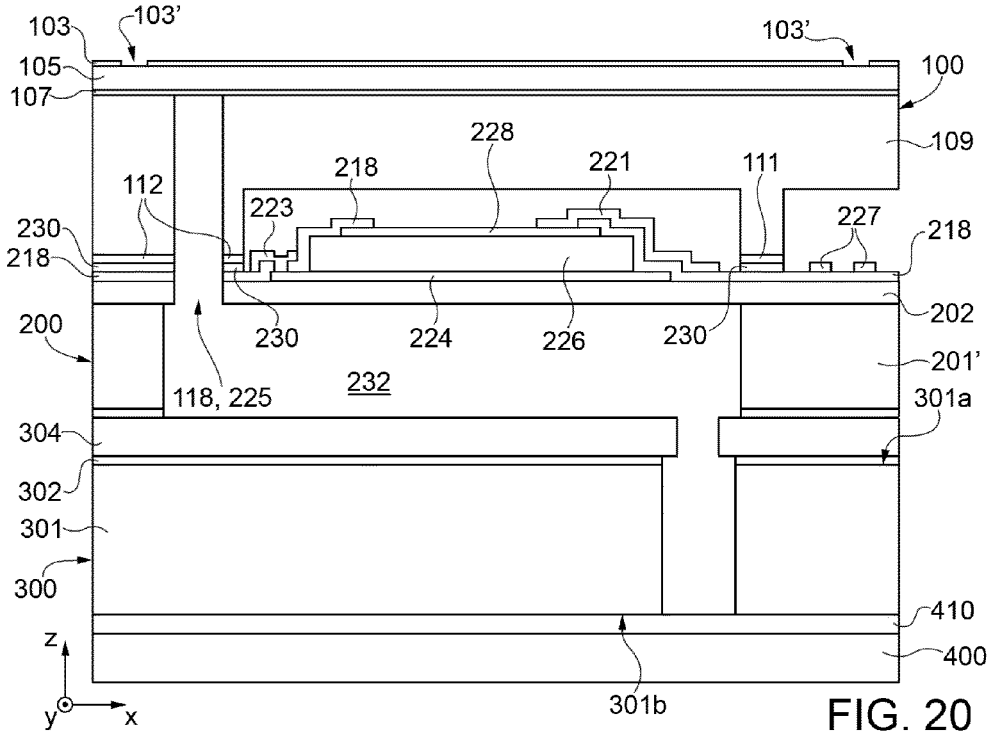

With reference to FIG. 20, the substrate 101 of the wafer 100 is completely removed by means of a grinding step and a subsequent step of chemical etching to remove possible residue of the substrate 101 not removed by the grinding step. The chemical etching presents moreover the advantage of being more precise than grinding, and chemical etching can be chosen in such a way as to be selective in regard to the material to be removed, with etch stopping at the intermediate layer 103.

It is hence advisable in this step to provide alignment markers 103' on the exposed intermediate layer 103. Said markers 103' have the function of identifying with high precision, in subsequent machining steps, the spatial arrangement of the channel 118 where the fluid ejection nozzle is to be formed.

Figure 21:
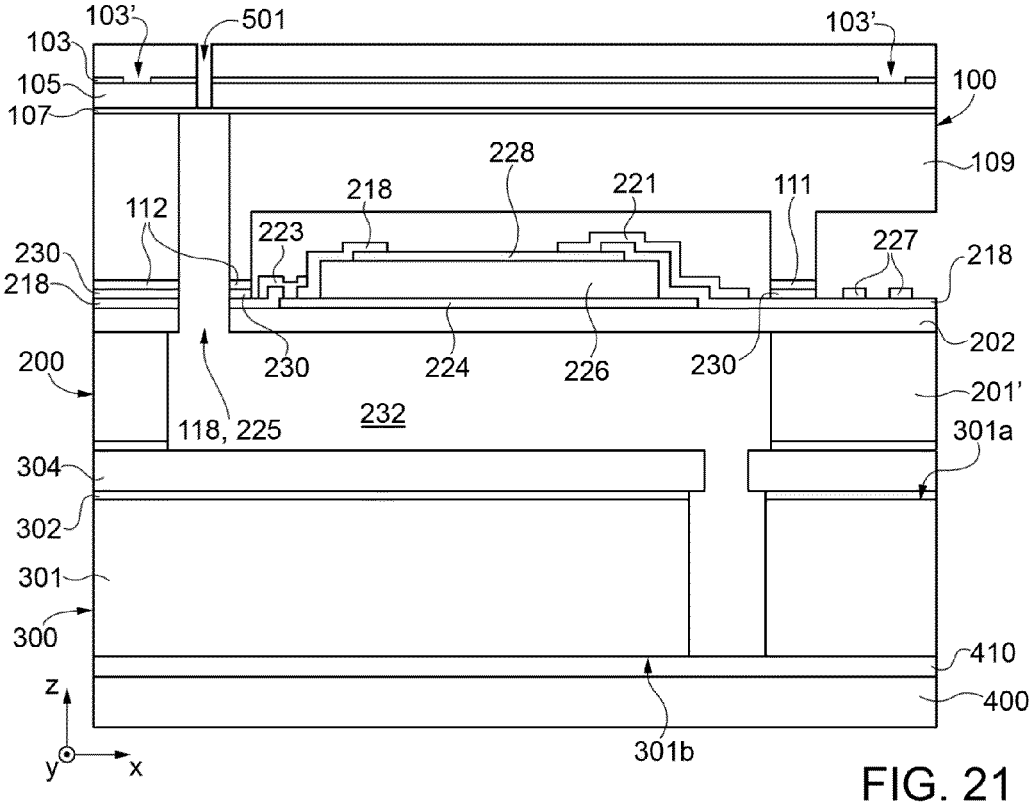
Figure 22:
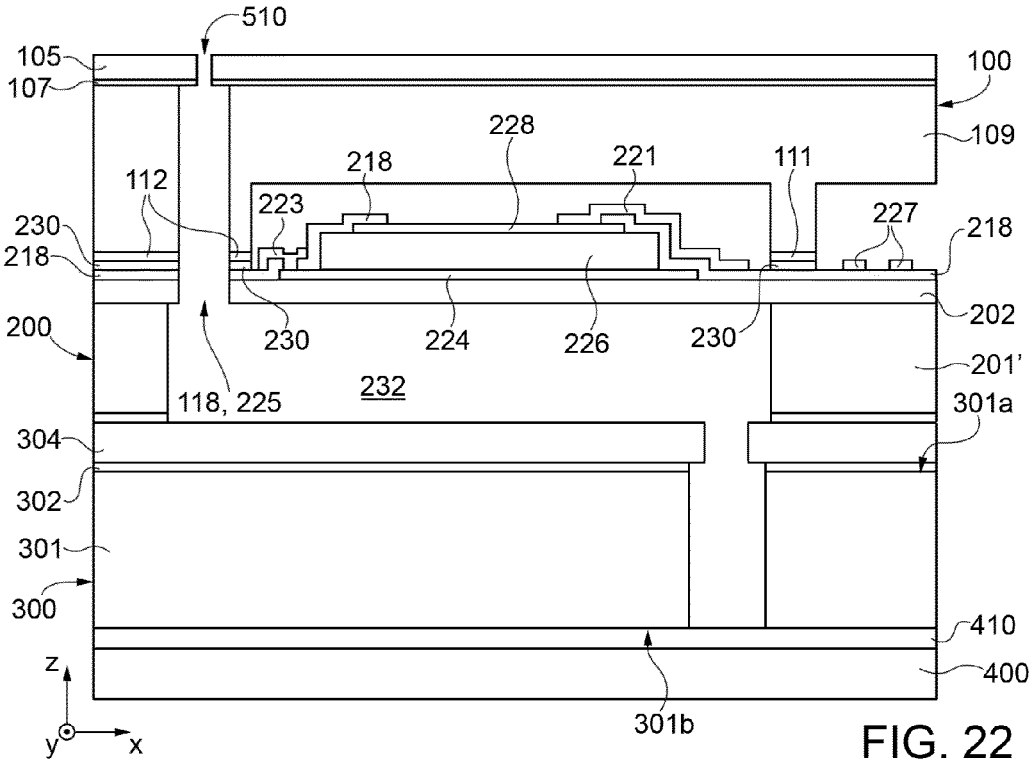

With reference to FIG. 21, steps of deposition of a resist mask 502, lithography of the resist layer 502, and etching of the underlying intermediate layer 103 are carried out. A new etch using the same resist mask 502 enables removal of selective portions of the structural layer 105 exposed through the resist mask 502 so as to form a trench 501 that extends throughout the thickness of the structural layer 105 in an area corresponding to the channel 118 and aligned, in the direction Z, with the channel 118.

The etch is interrupted at the intermediate layer 107. A subsequent etching step (FIG. 22) enables removal of the portion of the intermediate layer 107 exposed through the trench 501. The resist mask is removed, and the intermediate layer 103 is etched up to complete removal thereof. In this way, a fluid ejection nozzle 510 is formed. In particular, the nozzle 510 has, in top view, a circular shape and a diameter chosen as desired, according to the application of the fluid ejection device and the amount of fluid that is to be ejected. Even more in particular, the nozzle 510 has, in perspective view, a cylindrical or frustoconical shape. The axis of the cylinder or truncated cone is aligned, along Z, with the axis of the channel 118.

Figure 23:
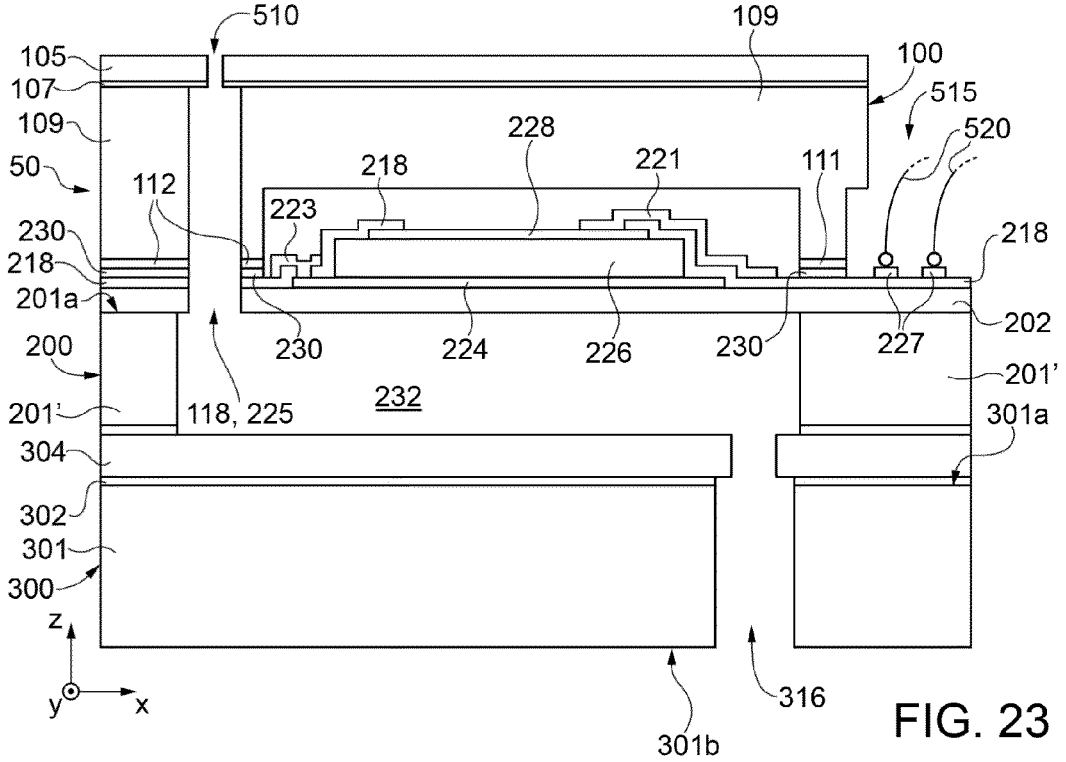

With reference to FIG. 23, production of the liquid-ejection device 50 is completed by removing the fourth wafer 400 and the thermal-release biadhesive tape 410, and by opening a window 515 through the wafer 100 to make the conductive pads 227 accessible from outside.

Removal of the fourth wafer 400 and the thermal-release biadhesive tape 410 moreover renders the inlet channel 316 fluidically accessible from outside.

Furthermore, it is possible to form electrical connections 520, for example by means of conductive wires, in the area of the pads 227. By appropriately biasing the pads 227 through the electrical connections 520, the piezoelectric element 226 is actuated in use.

Figure 24:
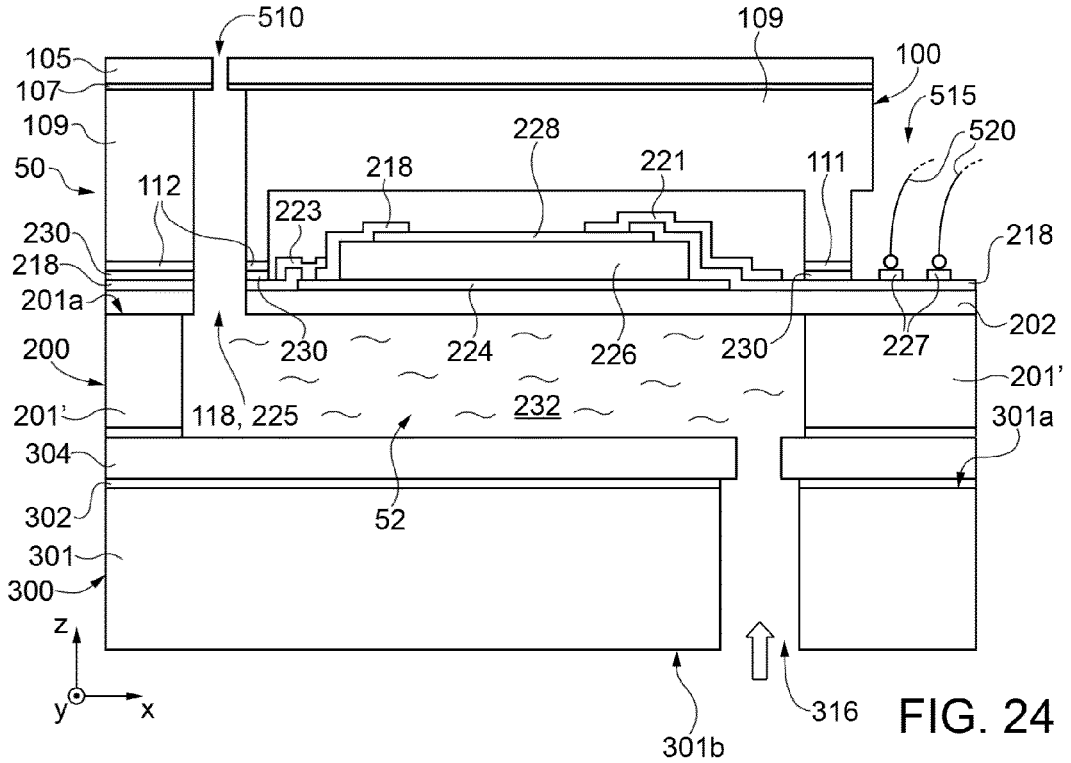
FIGS. 24-26 show the fluid ejection device machined according to the steps of FIGS. 2-23 during respective operating steps.
Figure 25:
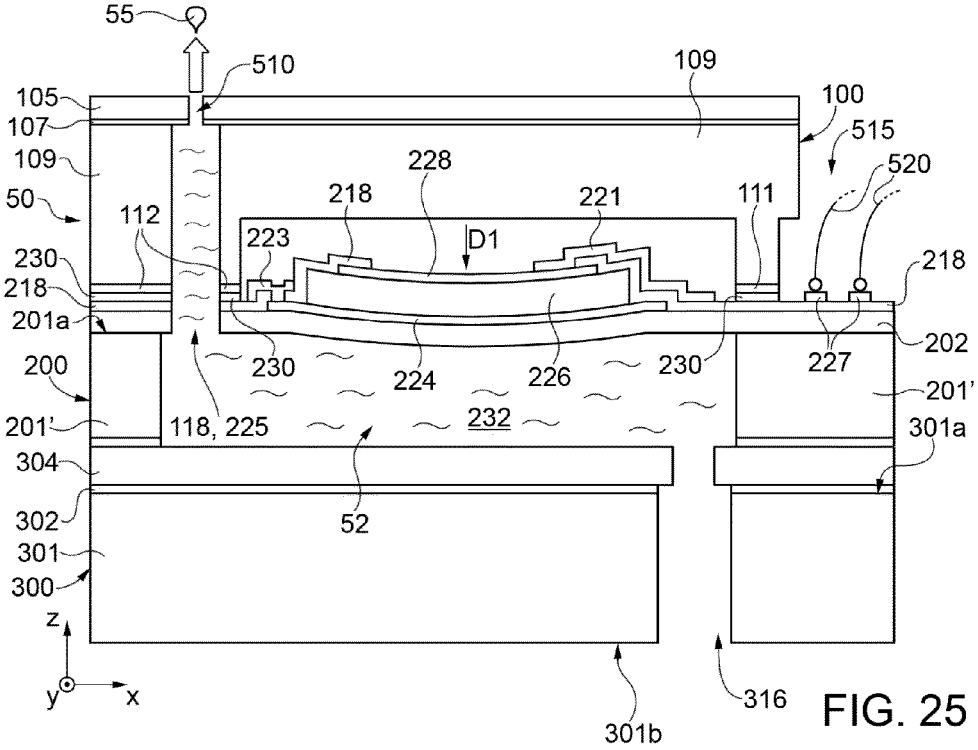
Figure 26:
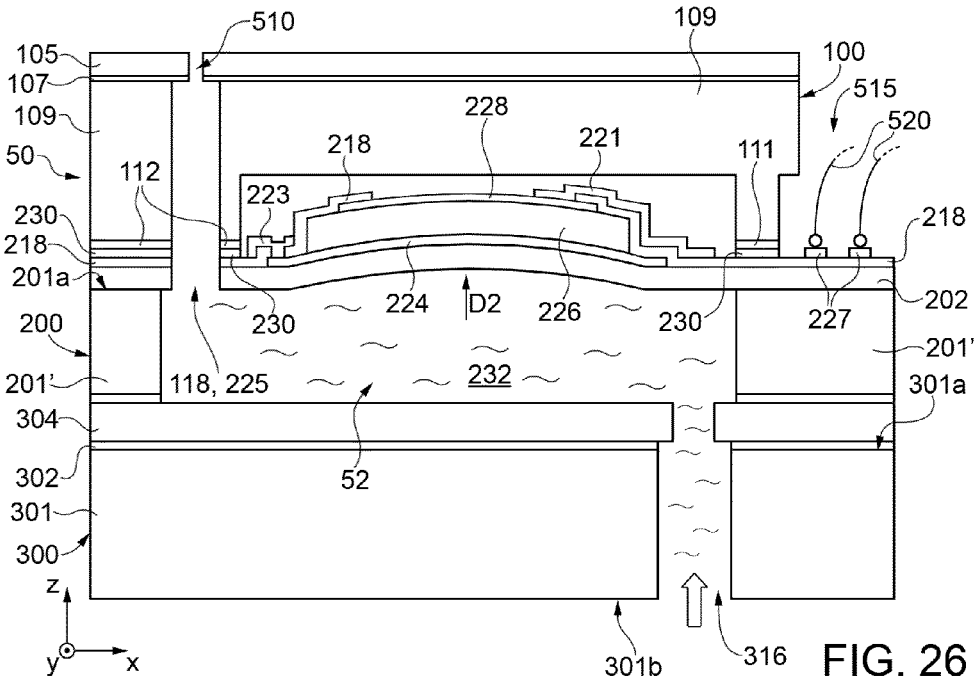

FIGS. 24-26 show the liquid-ejection device 50 in operating steps during use.

In a first step (FIG. 24), the chamber 232 is filled with a fluid 52 that is to be ejected. Said step of charging of the fluid 52 is carried out through the inlet channel 316 (see arrow 530).

As shown in FIG. 25, the piezoelectric element 226 is controlled through the top electrode 228 and the bottom electrode 224 (which are biased through the electrical connections 520) in such a way as to generate a deflection of the membrane layer 202 towards the inside of the chamber 232 (arrow D1). Said deflection causes a movement of the fluid 52 through the channel 118 towards the nozzle 510 and generates controlled expulsion of a drop 55 of fluid 52 towards the outside of the fluid ejection device 50.

As shown in FIG. 26, the piezoelectric element 226 is controlled through the top electrode 228 and the bottom electrode 224 (which are biased through the electrical connections 520) in such a way as to generate a deflection of the membrane layer 202 in a direction opposite to that of FIG. 25 (arrow D2) so as to increase the volume of the chamber 232 by recalling further fluid 52 towards the chamber 232 through the inlet channel 316. The chamber 232 is hence recharged with fluid 52.

The piezoelectric element may then again be actuated, as illustrated in FIG. 25, for expulsion of a further drop of fluid. The steps of FIGS. 25 and 26 are repeated throughout the printing process.

Actuation of the piezoelectric element by biasing the top electrode 228 and bottom electrode 224 is in itself known and not described in detail herein.

From an examination of the characteristics of the disclosure provided according to the present disclosure, the advantages that it affords are evident.

In particular, the steps of manufacture of the liquid-ejection device according to the present disclosure utilize coupling of just three wafers, reducing the risks of misalignment in so far as just two steps of coupling between wafers (i.e., the step of FIG. 14A and the step of FIG. 17) are performed, and the manufacturing costs are reduced.

Finally, it is clear that modifications and variations may be made to what has been described and illustrated herein, without thereby departing from the sphere of protection of the present disclosure.

For instance, the steps described with reference to FIG. 2 are not necessary in the case where a pre-machined wafer of a SOI (Silicon-On-Insulator) type is purchased. However, it should be noted that this latter solution has a cost higher than the one associated with the steps of FIG. 2. Likewise, also the wafers 200 and 300 may be of the SOI type.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method for manufacturing a fluid ejection device, the method comprising:

forming a first recess in a first semiconductor body by removing selective portions of the first semiconductor body, the first semiconductor body including a membrane layer and a piezoelectric actuator located over the membrane, wherein the selective portions are removed until the membrane layer is reached;

forming an intermediate through hole through the membrane layer by removing a selective portion of the membrane layer; providing a second semiconductor body having a first surface and a second surface;

forming a second recess in a third semiconductor body;

forming an outlet through hole in the third semiconductor body by removing selective portions of the third semiconductor body outside of said second recess, said outlet through hole being a fluid ejection nozzle of the fluid ejection device;

coupling together the first and third semiconductor bodies, wherein the coupling includes housing the piezoelectric actuator in the first recess, wherein the intermediate through hole, the first recess, and the outlet through hole are fluidically coupled to each other; and coupling together the first and second semiconductor bodies, wherein the coupling includes forming a chamber inside the fluid ejection device with a first surface of the second semiconductor body facing the first recess.

2. The method according to claim 1, wherein the first semiconductor body includes a substrate having a first surface and a second surface, the method further including:

forming the membrane layer on the first surface of the substrate, and wherein removing selective portions of the first semiconductor body includes selectively etching said first substrate in a region that is at least partially aligned with the piezoelectric element.

3. The method according to claim 1, further comprising forming, in the second semiconductor body, an inlet through hole configured to fluidically couple the first and second surfaces of the third semiconductor body with one another.

4. The method according to claim 3, wherein coupling together the first and second semiconductor bodies includes causing the inlet through hole to be fluidically coupled to said chamber.

5. The method according to claim 3 further comprising:

forming, on a surface of a substrate, an etch-stop layer that is selectively etchable with respect to the substrate; and forming, on said etch-stop layer, a third structural layer, and wherein forming the inlet through hole includes:

before coupling together the first and second semiconductor bodies, forming a trench by removing selective portions of the third structural layer until a surface region of the etch-stop layer is exposed, and removing selective portions of the etch-stop layer exposed through said trench; and after coupling together the first and second semiconductor bodies, removing selective portions of the substrate until said trench is reached.

6. The method according to claim 1, wherein prior to forming the second recess in the third semiconductor body. the method includes:

forming, on said third semiconductor body, a first structural layer;

forming, on the first structural layer, a first intermediate layer; and forming a second structural layer on the first intermediate layer, wherein forming the second recess includes etching selective portions of the second structural layer, and forming the outlet through hole includes removing selective portions of the first structural layer, of the first intermediate layer, and of the second structural layer aligned with one another in a second direction.

7. The method according to claim 6, wherein the ejection nozzle of the fluid ejection device is formed in an area corresponding to the first structural layer.

8. The method according to claim 6, wherein forming the outlet through hole includes:

forming a first trench in the second structural layer by selectively etching the second structural layer until a first surface portion of the first intermediate layer is exposed;

forming a second trench in the first structural layer by selectively etching the first structural layer until a second surface portion of the first intermediate layer opposite to and facing the first surface portion of the first intermediate layer is exposed; and fluidically coupling the first and second trenches by etching the first intermediate layer in the first or second surface portions.

9. The method according to claim 8, the method further comprising:

forming a second intermediate layer on a first surface of a substrate; and forming the first structural layer on the second intermediate layer, and wherein forming the first outlet through hole includes removing the substrate before etching the first structural layer.

10. The method according to claim 9, wherein removing the substrate and selectively etching portions of the first structural layer are carried out after coupling together the first and third semiconductor bodies.

11. The method according to claim 1, wherein coupling together the first and third semiconductor bodies comprises forming a first bonding layer on surface regions of the second structural layer that surround said first recess and said outlet through hole, and wherein coupling together the first and second semiconductor bodies comprises forming a second bonding layer on surface regions of the first semiconductor body that surround the first recess.

12. The method according to claim 1, further comprising forming the first semiconductor body by steps including forming the membrane layer on a first surface of a first substrate;

forming a first conductive electrode on the membrane layer;

forming a piezoelectric element on, and electrically coupled to, the first electrode; and forming a conductive second electrode on, and electrically coupled to, the piezoelectric element, wherein said first and second electrodes and said piezoelectric element form the piezoelectric actuator.

13. The method according to claim 12, further comprising:

forming a first conductive pad and a second conductive pad over the first surface of the first semiconductor body, at a distance from said piezoelectric actuator;

forming a first conductive path electrically coupled to the first electrode and to the first conductive pad; and forming a second conductive path electrically coupled to the second electrode and to the second conductive pad, and wherein coupling together the first and third semiconductor bodies is carried out in such a way that the first and second conductive pads are located outside the chamber.

14. A fluid ejection device, comprising:

a first semiconductor body including a piezoelectric actuator and a membrane partially suspended over a first recess that extends into said first semiconductor body;

a second semiconductor body coupled to the first semiconductor body at the first recess and defining a first chamber inside the fluid ejection device;

an intermediate through hole that extends through the membrane in fluid connection with the first chamber; and a third semiconductor body including a second recess and an outlet through hole that extends through the third semiconductor body outside the second recess, the third semiconductor body being coupled to the first semiconductor body with the piezoelectric actuator being housed in said second recess, said outlet through hole being in fluid connection with the intermediate through hole and the first chamber.

15. The device according to claim 14, wherein the second recess forms a second chamber inside the fluid ejection device, the second chamber being fluidically isolated from said first internal chamber.

16. The device according to claim 14, wherein the third semiconductor body includes:

a first structural layer;

a first intermediate layer located over the first structural layer; and a second structural layer located over the first intermediate layer, wherein the outlet through hole extends through the first structural layer, the first intermediate layer, and the second structural layer and forms, in a region corresponding to the first structural layer, an ejection nozzle of the fluid ejection device.

17. The device according to claim 14, wherein the second semiconductor body has a first surface and a second surface, the second semiconductor body including an inlet through hole that extends through the second semiconductor body in fluid communication with the first chamber.

18. The device according to claim 14, wherein the piezoelectric actuator includes:

a conductive first electrode located over the membrane;

a piezoelectric element located over and electrically coupled to the first electrode; and a conductive second electrode located over and is electrically coupled to the piezoelectric element.

19. The device according to claim 18, wherein said piezoelectric actuator is configured to be controlled to cause displacement of the membrane, wherein the displacement caused by the piezoelectric actuator is at least one of towards the first chamber and away from the first chamber.

* * * * *